US008823753B2

(12) United States Patent
Kim et al.

(10) Patent No.: US 8,823,753 B2
(45) Date of Patent: Sep. 2, 2014

(54) DISPLAY DRIVER CIRCUIT

(75) Inventors: In-Suk Kim, Suwon-si (KR); Jae-Goo Lee, Yongin-si (KR); Jae-Hyuck Woo, Osan-si (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 1218 days.

(21) Appl. No.: 12/716,614

(22) Filed: Mar. 3, 2010

(65) Prior Publication Data

US 2010/0225678 A1 Sep. 9, 2010

(30) Foreign Application Priority Data

Mar. 4, 2009 (KR) ..... 2009-18537

(51) Int. Cl.
*G09G 5/10* (2006.01)

(52) U.S. Cl.
USPC ..... 345/690; 345/84; 345/88; 345/89; 345/105; 345/211

(58) Field of Classification Search
USPC ..... 345/690, 84, 88, 89, 105, 107, 109, 345/211, 204
See application file for complete search history.

(56) References Cited

U.S. PATENT DOCUMENTS

| | | | | |
|---|---|---|---|---|
| 2003/0231153 | A1 | 12/2003 | Seong et al. | |
| 2004/0075674 | A1 * | 4/2004 | Bu | 345/690 |
| 2007/0146395 | A1 * | 6/2007 | Lee | 345/690 |

FOREIGN PATENT DOCUMENTS

| | | |
|---|---|---|
| JP | 2004-029795 | 1/2004 |
| JP | 2007-206621 | 8/2007 |
| KR | 10-434504 | 5/2004 |
| KR | 10-674678 | 1/2007 |

* cited by examiner

*Primary Examiner* — LunYi Lao
*Assistant Examiner* — Shaheda Abdin
(74) *Attorney, Agent, or Firm* — Stanzione & Kim, LLP

(57) ABSTRACT

A display driver circuit configured to be shared by three grey-scale voltage generators to be respectively used with red (R), green (G) and blue (B) colors. In particular, two of the three grey-scale voltage generators share first and second resistor strings, gamma voltage selectors, and gamma adjustment buffers provided in the other grey-scale voltage generator, thereby reducing the size and power consumption of the display driver circuit. Also, when only a single grey-scale voltage is output, it is possible to deactivate the grey-scale voltages provided by two of the grey-scale generators and further reduce power consumption.

12 Claims, 5 Drawing Sheets

DISPLAY DRIVER CIRCUIT

CROSS-REFERENCE TO RELATED APPLICATIONS

This application claims the benefit of priority under 35 U.S.C. §119(a) from Korean Patent Application No. 10-2009-0018537, filed on Mar. 4, 2009, in the Korean Intellectual Property Office, the disclosure of which is incorporated herein by reference in its entirety.

BACKGROUND

1. Field of the Invention

Example embodiments relate to a display driver circuit, and more particularly, to a display driver circuit having separate grey-scale voltage generators according to red (R), green (G) and blue (B) colors.

2. Description of the Related Art

A thin film transistor (TFT) liquid crystal display (LCD) is widely used in notebook personal computers (PCs), monitors, etc., particularly as a color display.

A color LCD screen shows one color by combining colors passed through R, G and B color filters. A voltage applied to a source electrode of a TFT LCD in order to show each of R, G and B colors is referred to as a grey-scale voltage, which is output from a driver integrated circuit (IC) for driving a display. The brightness of a color varies according to the level of the grey-scale voltage.

According to the conventional art, the R, G and B grey-scale voltages are generated from one grey-scale voltage generator. In other words, a grey-scale voltage generator generates the same grey-scale voltages for R, G and B colors. This is based on the assumption that an electro-optic characteristic, that is, luminance is the same for R, G and B pixels. However, the luminances of R, G and B pixels are actually slightly different. In other words, the luminances of R, G and B pixels with respect to the same grey-scale voltage are not the same. For this reason, a G-white or R-black screen in which fine G or R color can be seen is output in a white or black screen.

To solve this problem, a display driver circuit has been provided with separate grey-scale voltage generators for respectively generating grey-scale voltages for R, G and B colors. However, the separate grey-scale voltage generators require a layout area three times as large as a conventional grey-scale voltage generator and also power consumption three times that of a conventional grey-scale voltage generator.

Furthermore, once a display driver circuit is implemented by separate grey-scale voltage generators, outputs of the separate grey-scale voltage generators are respectively applied to the R, G and B pixels even if the R, G and B pixels are driven by the same grey-scale voltage. Thus, all the separate grey-scale voltage generators must be driven, and power consumption is not reduced.

SUMMARY

Example embodiments of the present general inventive concept provide a display driver circuit having separate grey-scale voltage generators that occupy a reduced layout area and consume less power.

Additional aspects and utilities of the present general inventive concept will be set forth in part in the description which follows and, in part, will be obvious from the description, or may be learned by practice of the general inventive concept.

The foregoing and/or other features and utilities of the present general inventive concept may be achieved by providing a display driver circuit including a grey-scale voltage generation unit having first to third grey-scale voltage generators each to generate n (n is a natural number larger than 2) grey-scale voltages by selecting the maximum reference voltage and the minimum reference voltage from among first distribution voltages, selecting a predetermined number of voltages from among second distribution voltages, and distributing the predetermined number of voltages. Here, the first grey-scale voltage generator includes a first resistor string to generate the first distribution voltages by receiving and distributing first and second power supply voltages; and a second resistor string to generate the second distribution voltages by receiving and distributing the maximum and minimum reference voltages selected by the first grey-scale voltage generator.

In example embodiments, each of the first to third grey-scale voltage generators may include: a reference voltage selection register configured to output a maximum reference voltage selection signal and a minimum reference voltage selection signal; a gamma selection register configured to output a plurality of gamma selection signals; and a reference voltage selection unit having a maximum reference voltage selector to select the maximum reference voltage and to output the maximum reference voltage as a first grey-scale voltage in response to the maximum reference voltage selection signal, and a minimum reference voltage selector to select the minimum reference voltage and to output the minimum reference voltage as an nth grey-scale voltage in response to the minimum reference voltage selection signal.

In example embodiments, the first grey-scale voltage generator may further include a gamma adjustment register configured to output a plurality of gamma adjustment signals.

In example embodiments, the first grey-scale voltage generator may further include a grey-scale voltage adjustment unit having a first gamma selection unit having m (m is a natural number smaller than n) first gamma selectors each to select and to output one of voltages distributed by the second resistor string as a first gamma voltage in response to a corresponding one of the gamma selection signals; a third resistor string configured to generate second to $(n-1)^{th}$ grey-scale voltages by distributing gamma voltages applied from first and $m^{th}$ first gamma selectors among the m first gamma selectors; and a first gamma buffer unit having p (p is a natural number equal to or smaller than m) first fixed buffers to receive, buffer and output corresponding first gamma voltages among the m first gamma voltages to designated nodes among a plurality of nodes in the third resistor string, and (m−p) gamma adjustment buffers to select specific nodes among the nodes in the third resistor string in response to corresponding gamma adjustment signals among the gamma adjustment signals, and to receive, buffer and output corresponding first gamma voltages among the m first gamma voltages to the selected nodes.

In example embodiment, each of the second and third grey-scale voltage generators may further include a grey-scale voltage adjustment unit having a second gamma selection unit having p second gamma selectors each to select and output one of the voltages distributed by the second resistor string as a second gamma voltage in response to a corresponding one of the gamma selection signals; a fourth resistor string configured to generate second to $(n-1)^{th}$ grey-scale voltages by distributing gamma voltages applied from first and $p^{th}$ second gamma selectors among the p second gamma selectors; and a second gamma buffer unit having p second fixed buffers to receive, buffer and output corresponding second gamma voltages among the p second gamma voltages to designated nodes among the nodes in the third resistor string.

In example embodiments, each of the (m−p) gamma adjustment buffers may select a specific node among a plurality of nodes in the fourth resistor string in response to the corresponding one of the gamma adjustment signals, and receive, buffer and output the corresponding first gamma voltage among the m first gamma voltages to the selected node.

In example embodiment, each of the (m−p) gamma adjustment buffers may include: a first amplifier configured to receive the corresponding first gamma voltage and a feedback voltage, and sense, amplify and output a voltage difference; a plurality of second amplifiers configured to receive, amplify and output the output of the first amplifier to a corresponding node in the third or fourth resistor string, and apply the voltage output to the corresponding node to the first amplifier as the feedback voltage; and a switch configured to select at least one of the second amplifiers in response to the corresponding gamma adjustment signal, and transfer the output of the first amplifier to the selected second amplifier.

In example embodiment, the grey-scale voltage generation unit may further include: a first grey-scale voltage selection multiplexer (MUX) configured to select and output one of a first grey-scale voltage group of the n grey-scale voltages output from the first grey-scale voltage generator and a second grey-scale voltage group of the n grey-scale voltages output from the second grey-scale voltage generator in response to a single grey-scale voltage selection signal; and a second grey-scale voltage selection MUX configured to select and output one of the first grey-scale voltage group and a third grey-scale voltage group of the n grey-scale voltages output from the third grey-scale voltage generator in response to the single grey-scale voltage selection signal.

In example embodiment, the second and third grey-scale voltage generators may be deactivated in response to the single grey-scale voltage selection signal.

In example embodiment, the display driver circuit may further include: a controller configured to output a source driver control signal, a gate driver control signal, and the single grey-scale voltage selection signal in response to image data and a command applied from outside; a source driver configured to receive the first to third grey-scale voltage groups and apply a display data voltage to data lines of a display panel in response to the source driver control signal; and a gate driver configured to apply a gate-on voltage to gate lines of the display panel in response to the gate driver control signal.

The foregoing and/or other features and utilities of the present general inventive concept may also be achieved by providing a grey-scale voltage generator to generate grey-scale voltages used in a display driver circuit, including a maximum reference voltage selector to select a maximum grey-scale voltage from a power supplied first resistor string, a minimum reference voltage selector to select a minimum grey-scale voltage from the first resistor string, and a plurality of gamma selectors to select gamma voltages from a second resistor string provided in the other grey-scale voltage generator, wherein the first resistor string is provided in another grey-scale voltage generator.

The grey-scale voltage generator may further include a plurality of buffers fixed to respective points on a third resistor string provided in the grey-scale voltage generator, wherein the buffers respectively receive the selected gamma voltages from corresponding ones of the gamma selectors, buffer the gamma voltages, and output the buffered gamma voltages to the respective points on the third resistor string to be output as grey-scale voltages.

The third resistor string may have variable connection points coupled to corresponding variable connection points on a fourth resistor string provided in the other grey-scale voltage generator, to receive adjusted gamma voltages from the other grey-scale voltage generator to be output as grey-scale voltages.

The foregoing and/or other features and utilities of the present general inventive concept may also be achieved by providing a gamma voltage adjustment unit of a grey-scale voltage generator used in a display driver circuit, including a plurality of gamma adjustment buffers to connect to variable points on a first resistor string according to a desired adjustment so as to adjust received gamma voltages and output the adjusted gamma voltages to the first resistor string to be output as grey-scale voltages, wherein the gamma adjustment buffers also connect to variable points on a corresponding second resistor string in a second grey-scale voltage generator to supply the same adjusted gamma voltages to the corresponding second resistor string to output second grey-scale voltages from the second grey-scale voltage generator.

The gamma voltage adjustment unit may further include a maximum reference voltage selector to select a maximum grey-scale voltage from a third resistor string, and a minimum reference voltage selector to select a minimum grey-scale voltage from the third resistor string, wherein the second grey-scale voltage generator may also be connected to the third resistor string to select second maximum and minimum grey-scale voltages.

The gamma voltage adjustment unit may further include a plurality of gamma selectors to select gamma voltages from a fourth resistor string to output to the gamma adjustment buffers, wherein the second grey-scale voltage generator may also be connected to the fourth resistor string to select second gamma voltages.

The foregoing and/or other features and utilities of the present general inventive concept may also be achieved by providing a method of generating different sets of grey-scale voltages corresponding to different colors to be displayed on a display device, the method including selecting respective maximum and minimum grey-scale voltages to be used with each of the colors through a plurality of corresponding grey-scale voltage generators, processing adjusted gamma voltage values in a first one of the grey-scale voltage generators to be output as grey-scale voltages between the maximum and minimum grey-scale voltages, and transmitting the adjusted gamma voltage values from the first grey-scale voltage generator to at least a second one of the grey-scale voltage generators to be used in generating the grey-scale voltages regarding the color associated with the second grey-scale voltage generator.

The second grey-scale voltage generator may select the corresponding maximum and minimum grey-scale voltages from a first resistor string provided in the first grey-scale voltage generator.

The method may further include the second grey-scale voltage generator selecting gamma voltages from a second resistor string provided in the first grey-scale voltage generator.

The output grey-scale voltages of the first grey-scale voltage generator may be used in place of the output grey-scale voltages of the second grey-scale voltage generator in response to both sets of output grey-scale voltages having the same values.

BRIEF DESCRIPTION OF THE DRAWINGS

Example embodiments of the present general inventive concept are described in further detail below with reference to the accompanying drawings. It should be understood that various aspects of the drawings may have been exaggerated for clarity.

The above and/or other aspects of the present general inventive concept will become apparent and more readily appreciated from the following description of the exemplary embodiments, taken in conjunction with the accompanying drawings, in which.

DETAILED DESCRIPTION OF THE EMBODIMENTS

Figure 1:
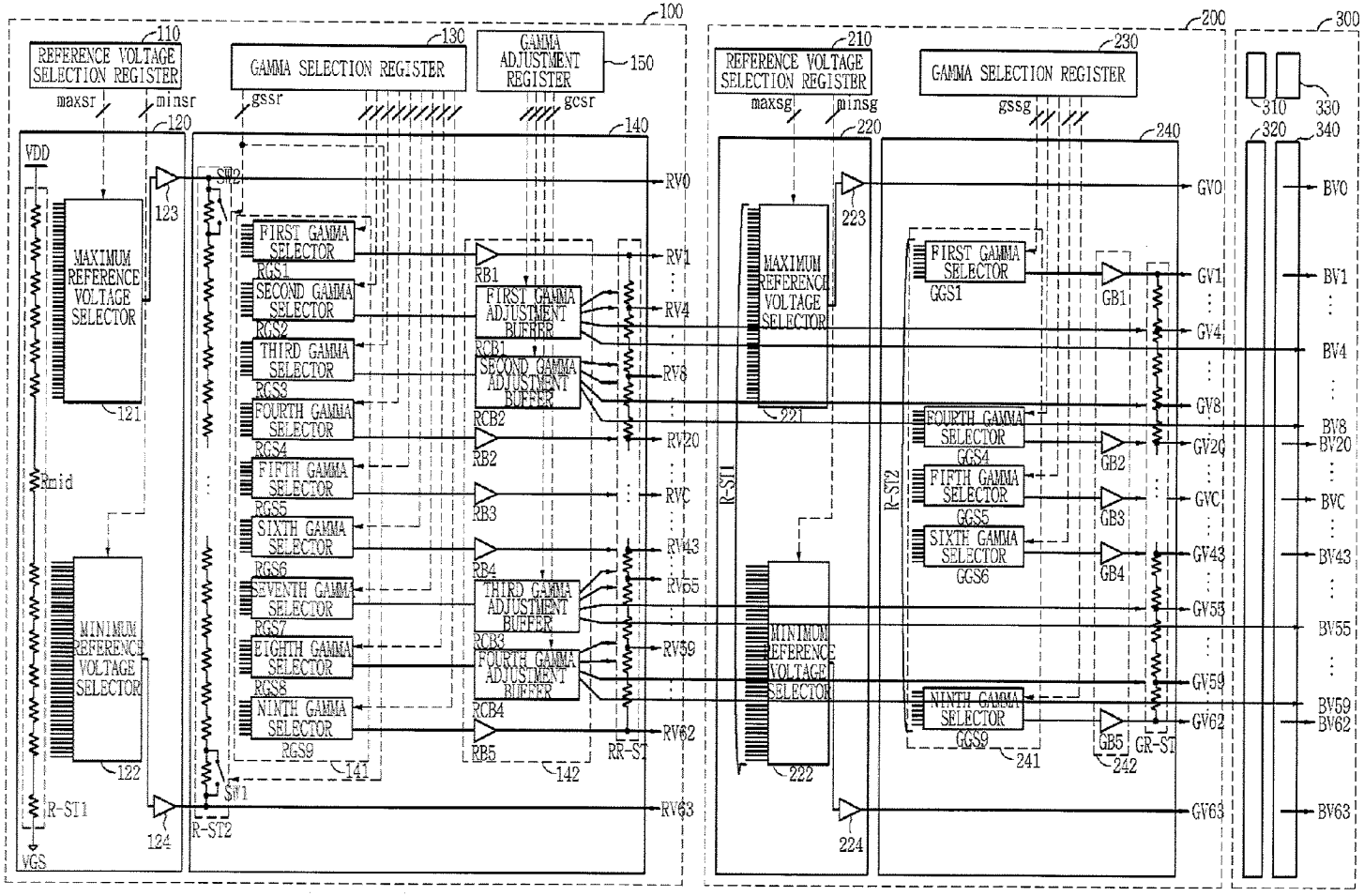
FIG. 1 illustrates a display driver circuit having separate grey-scale voltage generators according to an example embodiment of the present general inventive concept.

Various example embodiments of the present general inventive concept will now be described more fully with reference to the accompanying drawings in which some example embodiments of the present general inventive concept are illustrated. In the drawings, the thicknesses of layers and regions may be exaggerated for clarity.

Reference will now be made in detail to the embodiments of the present general inventive concept, examples of which are illustrated in the accompanying drawings, wherein like reference numerals refer to the like elements throughout. The embodiments of the present general inventive concept are described below in order to explain the present general inventive concept by referring to the figures.

Detailed illustrative embodiments of the present general inventive concept are disclosed herein. However, specific structural and functional details disclosed herein are merely representative for purposes of describing example embodiments of the present general inventive concept. This present general inventive concept, however, may be embodied in many alternate forms and should not be construed as limited to only example embodiments set forth herein.

Accordingly, while example embodiments of the present general inventive concept are capable of various modifications and alternative forms, embodiments thereof are shown by way of example in the drawings and will herein be described in detail. It should be understood, however, that there is no intent to limit example embodiments of the present general inventive concept to the particular forms disclosed, but on the contrary, the described example embodiments of the present general inventive concept are to cover all modifications, equivalents, and alternatives falling within the scope of the present general inventive concept and which may not be specifically described in the following descriptions. Like numbers refer to like elements throughout the description of the figures.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present general inventive concept. As used herein, the term "and/or" includes any and all combinations of one or more of the associated listed items.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments of the present general inventive concept only and is not intended to be limiting of example embodiments of the present general inventive concept. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, operations, elements and/or components, but do not preclude the presence or addition of one or more other features, integers, operations, elements, components and/or groups thereof. Spatially relative terms, such as "beneath," "below," "lower," "above," "upper" and the like, may be used herein for ease of description to describe one element or a relationship between a feature and another element or feature as illustrated in the figures. It will be understood that the spatially relative terms are intended to encompass different orientations of the device in use or operation in addition to the orientation depicted in the Figures. For example, if the device in the figures is turned over, elements described as "below" or "beneath" other elements or features would then be oriented "above" the other elements or features. Thus, for example, the term "below" can encompass both an orientation which is above as well as below. The device may be otherwise oriented (rotated 90 degrees or viewed or referenced at other orientations) and the spatially relative descriptors used herein should be interpreted accordingly.

Example embodiments of the present general inventive concept may be described herein with reference to cross-sectional illustrations that are schematic illustrations of idealized embodiments (and intermediate structures). As such, variations from the shapes of the illustrations as a result, for example, of manufacturing techniques and/or tolerances, may be expected. Thus, example embodiments of the present general inventive concept should not be construed as being limited to the particular shapes of regions illustrated herein but may include deviations in shapes that result, for example, from manufacturing. For example, an implanted region illustrated as a rectangle may have rounded or curved features and/or a gradient (e.g., of implant concentration) at its edges rather than an abrupt change from an implanted region to a non-implanted region. Likewise, a buried region formed by implantation may result in some implantation in the region between the buried region and the surface through which the implantation may take place. Thus, the regions illustrated in the figures are schematic in nature and their shapes do not necessarily illustrate the actual shape of a region of a device and do not limit the scope.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

In order to more specifically describe example embodiments of the present general inventive concept, various aspects, features, etc., will be described in detail with reference to the attached drawings. However, the present general inventive concept is not limited to the example embodiments described.

Hereinafter, features of a display driver circuit according to the present general inventive concept will be described with reference to the accompanying drawings.

FIG. 1 illustrates a display driver circuit having separate grey-scale voltage generators according to an example embodiment of the present general inventive concept.

Although the embodiments discussed in regard to this and other figures are used in the RGB color system, it is understood that the present general inventive concept may also be applied to other color systems or combinations of color systems.

The display driver circuit of FIG. 1 may have separate grey-scale voltage generators 100, 200 and 300 to be used with respective red (R), green (G) and blue (B) colors, and the first to third grey-scale voltage generators 100, 200 and 300 may generate R grey-scale voltages RV0 to RV63, G grey-scale voltages GV0 to GV63, and B grey-scale voltages BV0 to BV63, respectively. The quantity of 64 levels of grey-scale voltages has been arbitrarily chosen to be referenced in this description, and it is understood that any of several levels of grey-scale voltages may be generated in place of the 64 levels described below.

In FIG. 1, the first grey-scale voltage generator 100 may generate and output the R grey-scale voltages RV0 to RV63.

The first grey-scale voltage generator 100 may include a reference voltage selection register 110, a reference voltage selection unit 120, a gamma selection register 130, a gamma voltage adjustment unit 140, and a gamma adjustment register 150.

The reference voltage selection register 110 may have a maximum reference voltage selection register (not illustrated) and a minimum reference voltage selection register (not illustrated), and may output a maximum reference voltage selection signal maxsr and a minimum reference voltage selection signal minsr to the reference voltage selection unit 120. The maximum reference voltage selection signal maxsr and the minimum reference voltage selection signal minsr may be respectively set in advance in the maximum reference voltage selection register and the minimum reference voltage selection register, or may be applied from outside of the reference voltage selection register 110. In FIG. 1, the first grey-scale voltage generator 100 may be assumed to generate the R grey-scale voltages RV0 to RV63, and thus the maximum reference voltage selection signal maxsr and the minimum reference voltage selection signal minsr are used with R grey-scale voltages.

Although the first grey-scale voltage generator 100 is described in this embodiment of the present general inventive concept as generating R grey-scale voltages, it is understood that such a configuration could also be used to generate G or B grey-scale voltages.

The reference voltage selection unit 120 may have a first resistor string R-ST1, a maximum reference voltage selector 121, a minimum reference voltage selector 122, and first and second reference buffers 123 and 124.

The first resistor string R-ST1 may have a plurality of resistors connected in series between a first power supply voltage VDD and a second power supply voltage VGS, and may output a plurality of voltages distributed between the first power supply voltage VDD and the second power supply voltage VGS.

The maximum reference voltage selector 121 may select the maximum reference voltage from among the voltages output from the first resistor string R-ST1 in response to receiving the maximum reference voltage selection signal maxsr output from the reference voltage selection register 110, and may output the selected maximum reference voltage. The minimum reference voltage selector 122 may select the minimum reference voltage from among the voltages output from the first resistor string R-ST1 in response to receiving the minimum reference voltage selection signal minsr output from the reference voltage selection register 110, and may output the selected minimum reference voltage. For example, the maximum reference voltage selector 121 may select one of voltages output between a middle resistor Rmid among the resistors of the first resistor string R-ST1 connected in series and the first power supply voltage VDD and may output this selected voltage as the maximum reference voltage, and the minimum reference voltage selector 122 may select one of voltages output between the middle resistor Rmid and the second power supply voltage VGS and may output this selected voltage as the minimum reference voltage. Thus, when the first power supply voltage VDD has a higher level than the second power supply voltage VGS, the maximum reference voltage has a higher level than the minimum reference voltage. The maximum and minimum reference voltage selectors 121 and 122 may be implemented by multiplexers (MUXs), decoders, etc.

The first reference buffer 123 may receive and buffer the maximum reference voltage and may output the first R grey-scale voltage RV0, and the second reference buffer 124 may receive and buffer the minimum reference voltage and may output the sixty-fourth R grey-scale voltage RV63. In an example embodiment of the present general inventive concept, it may be assumed that the first to third grey-scale voltage generators 100, 200 and 300 output the sixty-four R grey-scale voltages RV0 to RV63, sixty-four G grey-scale voltages GV0 to GV63, and sixty-four B grey-scale voltages BV0 to BV63, respectively. Thus, the maximum and minimum reference voltages output from the reference voltage selection unit 120 may be the first and sixty-fourth R grey-scale voltages RV0 and RV63, respectively. However, the number of grey-scale voltages output from each grey-scale voltage generator may be controlled. For example, when the number of grey-scale voltages output by each of the grey-scale voltage generators 100, 200 and 300 is n (wherein n is a natural number larger than 2), the maximum and minimum reference voltages output from the first and second reference buffers 123 and 124 are the first and nth R grey-scale voltages RV0 and RVn−1.

The gamma selection register 130 may output a plurality of gamma selection signals gssr. Like the maximum and minimum reference voltage selection signals maxsr and minsr, the gamma selection signals gssr may be respectively set in advance in the gamma selection register 130, or applied from outside of the gamma selection register 130.

The gamma voltage adjustment unit 140 may have a second resistor string R-ST2, a gamma selection unit 141, a gamma buffer unit 142, and a third resistor string RR-ST.

The second resistor string R-ST2 may have a plurality of resistors connected in series between the maximum reference voltage and the minimum reference voltage received from the reference voltage selection unit 120, and two switches SW1 and SW2, and may output a plurality of gamma voltages. The two switches SW1 and SW2 may be respectively connected in parallel with resistors placed at both ends of the second resistor string R-ST2, and may be turned on/off in response to the gamma selection signals gssr. In other words, as the two switches SW1 and SW2 are turned on/off, the maximum and minimum voltages among the gamma voltages output from the second resistor string R-ST2 may vary.

The gamma selection unit 141 may have a plurality of gamma selectors RGS1 to RGS9. In response to a corresponding one of the gamma selection signals gssr, each of the gamma selectors RGS1 to RGS9 may select one of the gamma voltages output from the second resistor string R-ST2 and may output the selected gamma voltage. The first to ninth gamma selectors RGS1 to RGS9 may select the gamma voltages output from the second resistor string R-ST2 in a decreasing order of voltage level. The second gamma selector RGS2 may select and output one of the gamma voltages output from the second resistor string R-ST2 having a lower level than a gamma voltage selected and output by the first gamma selector RGS1, the third gamma selector RGS3 may select and output one of the gamma voltages output from the second resistor string R-ST2 having a lower level than the gamma voltage selected and output by the second gamma selector RGS2, the ninth gamma selector RGS9 may select and output one of the gamma voltages output from the second resistor string R-ST2 having a lower level than a gamma voltage selected and output by the eighth gamma selector RGS8, and so on. Thus, the gamma voltages output from the respective first to ninth gamma selectors RGS1 to RGS9 may have decreasing voltage levels in sequence. In FIG. 1, the gamma selection unit 141 has the nine gamma selectors RGS1 to RGS9, but the number of gamma selectors may vary. Gamma voltages output from the gamma selection unit 141 may be matched with points in a gamma characteristic curve corresponding to R color among gamma voltages that the display panel uses, and output. The higher a number of gamma selectors included in the gamma selection unit 141, the higher the number of gamma voltages may be output from the gamma selection unit 141, and the gamma voltages output from the gamma selection unit 141 approximate a gamma characteristic curve. Like the maximum and minimum reference voltage selectors 121 and 122, the gamma selectors RGS1 to RGS9 may be implemented by MUXs, decoders, or the like. For example, when the gamma selectors RGS1 to RGS9 are implemented by decoders that select and output one of sixty-four gamma voltages in response to the 6-bit gamma selection signals gssr, each of the gamma selectors RGS1 to RGS9 may use about 700 to 800 transistors. As the number of gamma selectors increases, the size of a gamma voltage generation unit steeply increases, and thus the number of gamma selectors should be adjusted during design.

The gamma buffer unit 142 may have a plurality of fixed buffers RB1 to RB5 and a plurality of gamma adjustment buffers RCB1 to RCB4. The numbers of the fixed buffers RB1 to RB5 and the gamma adjustment buffers RCB1 to RCB4 may be adjusted, but the sum of the numbers of the fixed buffers RB1 to RB5 and the gamma adjustment buffers RCB1 to RCB4 is equal to the number of the gamma selectors RGS1 to RGS9. In other words, each of the fixed buffers RB1 to RB5 and the gamma adjustment buffers RCB1 to RCB4 may correspond to one of the gamma selectors RGS1 to RGS9, and receives, buffers and outputs a gamma voltage output from the corresponding gamma selector. The fixed buffers RB1 and RB5 corresponding to the gamma selectors RGS1 and RGS9 buffer gamma voltages output from the gamma selectors RGS1 and RGS9 and output the second and sixty-third grey-scale voltages RV1 and RV62. The second and sixty-third grey-scale voltages RV1 and RV62 are output because it is assumed that the grey-scale voltage generator 100 outputs the sixty-four grey-scale voltages RV0 to RV63. In a configuration in which the number of output grey-scale voltages is n (wherein n is a natural number larger than 2), the fixed buffers RB1 and RB5 may output the second and (n−1)th grey-scale voltages RV1 and RVn−2, respectively.

The third resistor string RR-ST may have a plurality of resistors connected in series between the second and sixty-third grey-scale voltages RV1 and RV62 output from the fixed buffers RB1 and RB5, and may output the grey-scale voltages RV2 to RV61. Each of the fixed buffers RB1 to RB5 may buffer and apply the corresponding gamma voltage to the corresponding node among a plurality of nodes between the resistors of the third resistor string RR-ST. Also, the gamma adjustment buffers RCB1 to RCB4 may buffer and apply the corresponding gamma voltages to the corresponding nodes among the nodes between the resistors of the third resistor string RR-ST, but may be configured to select nodes to which the gamma voltages are applied in response to a gamma adjustment selection signal gcsr received from the gamma adjustment register 150. In other words, the respective fixed buffers RB1 to RB5 may have designated nodes in the third resistor string RR-ST to which gamma voltages are applied, but the gamma adjustment buffers RCB1 to RCB4 may select nodes to which gamma voltages are applied.

The grey-scale voltages RV2 to RV61 may be output through the nodes between the resistors of the third resistor string RR-ST. However, some of the nodes of the third resistor string RR-ST may have fixed voltage levels due to the gamma voltages applied through the fixed buffers RB1 to RB5, and nodes selected by the gamma adjustment buffers RCB1 to RCB4 may also have fixed voltage levels due to the gamma voltages applied through the gamma adjustment buffers RCB1 to RCB4. Nodes between the nodes receiving the gamma voltages through the fixed buffers RB1 to RB5 and the gamma adjustment buffers RCB1 to RCB4 may have voltage levels distributed by the resistors. The voltage levels of nodes designated in the third resistor string RR-ST may be output as the grey-scale voltages RV2 to RV61.

Gamma voltages output from the gamma selection unit 141 may be matched with points in a gamma characteristic curve, and the third resistor string RR-ST may differentially distribute and output the gamma voltages output from the gamma selection unit 141 such that the grey-scale voltages RV0 to RV63 are matched with the gamma characteristic curve. In FIG. 1, the gamma adjustment buffers RCB1 to RCB4 can select nodes in the third resistor string RR-ST to which gamma voltages are applied. Thus, the first grey-scale voltage generator 100 of FIG. 1 can precisely adjust the grey-scale voltages RV0 to RV63, and can be widely used in panels having different gamma characteristics. However, in an example embodiment of the present general inventive concept, the gamma adjustment buffers RCB1 to RCB4 may be configured to output gamma voltages used with G and B colors as well as the R color. In other words, the gamma adjustment buffers RCB1 to RCB4 may be configured to select specific nodes in the third resistor string RR-ST and apply gamma voltages, and may also be configured to select specific nodes in third resistor strings GR-ST and BR-ST of the second and third grey-scale voltage generators 200 and 300 and simultaneously apply gamma voltages to be used with the respective G and B colors.

In FIG. 1, the first and second resistor strings R-ST1 and R-ST2 are included in the first grey-scale voltage generator 100, but may be prepared outside the first to third grey-scale voltage generators 100, 200 and 300.

Since the second and third grey-scale voltage generators 200 and 300 may have the same configuration, only the constitution of the second grey-scale voltage generator 200 will be described.

Similar to the first grey-scale voltage generator 100, the second grey-scale voltage generator 200 may have a reference voltage selection register 210, a reference voltage selection unit 220, a gamma selection register 230, and a gamma voltage adjustment unit 240.

Like the reference voltage selection register 110 of the first grey-scale voltage generator 100, the reference voltage selection register 210 may have a maximum reference voltage selection register (not illustrated) and a minimum reference voltage selection register (not illustrated), and may output a maximum reference voltage selection signal maxsg and a minimum reference voltage selection signal minsg to the reference voltage selection unit 220. However, since it is assumed that the second grey-scale voltage generator 200 may generate the G grey-scale voltages GV0 to GV63, the maximum reference voltage selection signal maxsg and the minimum reference voltage selection signal minsg are used with G grey-scale voltages.

The reference voltage selection unit 220 may have a maximum reference voltage selector 221, a minimum reference voltage selector 222, and first and second reference buffers 223 and 224. However, unlike the reference voltage selection unit 120 of the first grey-scale voltage generator 100, the reference voltage selection unit 220 of the second grey-scale voltage generator 200 may not have the first resistor string R-ST1 but instead may share the first resistor string R-ST1 included in the first grey-scale voltage generator 100. The first resistor string R-ST1 may only differentially distribute and output first and second power supply voltages to generate the maximum and minimum reference voltages, and thus does not need to be included in each of the first to third grey-scale voltage generators 100 to 300.

The maximum reference voltage selector 221 and the minimum reference voltage selector 222 may select the maximum reference voltage and the minimum reference voltage from among the voltages output from the first resistor string R-ST1 included in the first grey-scale voltage generator 100 and output the maximum and minimum reference voltages in response to the maximum and minimum reference voltage selection signals maxsg and minsg received from the reference voltage selection register 210. The first reference buffer 223 may receive and buffer the maximum reference voltage and may output the first G grey-scale voltage GV0, and the second reference buffer 224 may receive and buffer the minimum reference voltage and may output the sixty-fourth G grey-scale voltage GV63.

The gamma selection register 230 may output a plurality of gamma selection signals gssg. The gamma voltage adjustment unit 240 may have a gamma selection unit 241, a gamma buffer unit 242, and the third resistor string GR-ST. However, unlike the gamma voltage adjustment unit 140, the gamma voltage adjustment unit 240 may not have a second resistor string but instead may share the second resistor string R-ST2 of the gamma voltage adjustment unit 140.

The gamma selection unit 241 may have a plurality of gamma selectors GGS1, GGS4, GGS5, GGS6, and GGS9. The gamma selection unit 241 of the second grey-scale voltage generator 200 may have only the gamma selectors GGS1, GGS4, GGS5, GGS6, and GGS9 corresponding to fixed buffers GB1 to GB5, unlike the gamma selection unit 141 of the first grey-scale voltage generator 100. Each of the gamma selectors GGS1, GGS4, GGS5, GGS6, and GGS9 may select and output one of the gamma voltages output from the second resistor string R-ST2 in response to the corresponding one of the gamma selection signals gssg.

The gamma buffer unit 242 may have only the fixed buffers GB1 to GB5. The gamma buffer unit 142 in the first grey-scale voltage generator 100 may have the fixed buffers RB1 to RB5 and the gamma adjustment buffers RCB1 to RCB4, while the gamma buffer unit 242 may have no gamma adjustment buffer and may use the gamma voltages output from the gamma adjustment buffers RCB1 to RCB4 of the gamma buffer unit 142 as they are. As described above, since the gamma adjustment buffers RCB1 to RCB4 are configured to select specific nodes in the third resistor strings GR-ST and BR-ST of the second and third grey-scale voltage generators 200 and 300 as well as the third resistor string RR-ST of the first grey-scale voltage generator 100 and apply gamma voltages, the second and third grey-scale voltage generators 200 and 300 may need no gamma adjustment buffers. The fixed buffers GB1 and GB5 may buffer the gamma voltages output from the gamma selectors GGS1 to GGS9 and output the second and sixty-third G grey-scale voltages GV1 and GV62.

The third resistor string GR-ST may have a plurality of resistors connected in series between the second and sixty-third G grey-scale voltages GV1 and GV62 output from the fixed buffers GB1 and GB5, and may output the G grey-scale voltages GV2 to GV61. Each of the fixed buffers GB1 and GB5 buffers and applies the corresponding gamma voltage to the corresponding one of a plurality of nodes between the resistors of the third resistor string GR-ST. The gamma adjustment buffers RCB1 to RCB4 of the first grey-scale voltage generator 100 may select specific nodes among nodes of the third resistor string GR-ST and apply gamma voltages to the nodes.

R, G and B gamma characteristic curves have similar patterns. For this reason, even if the gamma selection units 241 and 341 select gamma voltages corresponding to the G and B characteristic curves, and the third resistor strings GR-ST and BR-ST adjust G and B grey-scale voltages such that the second and third grey-scale voltage generators 200 and 300 share the second resistor string R-ST2, the second and third grey-scale voltage generators 200 and 300 may output gamma voltages matched with the G and B characteristic curves.

Thus, although the second and third grey-scale voltage generators 200 and 300 may share the first and second resistor strings R-ST1 and R-ST2 with the first grey-scale voltage generator 100, the second and third grey-scale voltage generators 200 and 300 can adjust their respective gamma voltages due to the third resistor strings GR-ST and BR-ST. In particular, since the gamma adjustment buffers RCB1 to RCB4 of the first grey-scale voltage generator 100 can select nodes in each of the third resistor strings RR-ST, GR-ST and BR-ST to which gamma voltages are applied, the second and third grey-scale voltage generators 200 and 300 do not need gamma selectors corresponding to the gamma adjustment buffers RCB1 to RCB4, and the size of the grey-scale voltage generators 200 and 300 can be remarkably reduced. Also, since the gamma voltage adjustment units 240 and 340 may have a smaller number of gamma selectors than the gamma voltage adjustment unit 140 and may have no gamma adjustment buffer, the number of the gamma selection signals gssg and gssb output respectively from the gamma selection registers 230 and 330 may be remarkably reduced.

In the above-described example embodiment of the present general inventive concept, the R grey-scale voltage generator 100 may have a different constitution from the G or B grey-scale voltage generator 200 or 300, and the G grey-scale voltage generator 200 and the B grey-scale voltage generator 300 may have the same configuration. However, the grey-scale voltage generator 100 having the different configuration may be used as a G or B grey-scale voltage generator rather than an R grey-scale voltage generator. When the grey-scale voltage generator 100 having the different configuration generates one of R, G and B gamma voltages, the other grey-scale voltage generators 200 and 300 corresponding to the other colors may have the same configuration.

Also, the resistors of each of the first to third resistor strings R-ST1, R-ST2, RR-ST, GR-ST and BR-ST connected in series may have different resistances.

Figure 2:
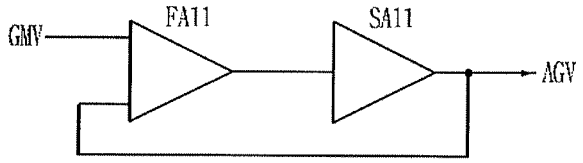
FIG. 2 is a circuit diagram illustrating an example of a fixed buffer of FIG. 1.

FIG. 2 is a circuit diagram illustrating an example of a fixed buffer of FIG. 1.

The fixed buffers RB1 to RB5, GB1 to GB5, and BB1 to BB5 may include a first amplifier FA11 and a second amplifier SA11. Among the buffers of the gamma buffer units 142, 242 and 342, the fixed buffers RB1 to RB5, GB1 to GB5, and BB1 to BB5 may be respectively connected with fixed nodes in the third resistor strings RR-ST, GR-ST and BR-ST and cannot adjust inflection points of gamma curves. The number and positions of the fixed buffers RB1 to RB5, GB1 to GB5, and BB1 to BB5 in the gamma buffer units 142, 242 and 342 may be changed without restriction. In the fixed buffers RB1 to RB5, GB1 to GB5, and BB1 to BB5, the first amplifier FA11 may amplify the difference between a gamma voltage GMV output from the corresponding gamma selector RGS1, RGS4, RGS5, RGS6, RGS9, GGS1, GGS4, GGS5, GGS6, GGS9, BGS1, BGS4, BGS5, BGS6, or BGS9 of the gamma selection unit 141, 241 or 341 and a buffered gamma voltage AGV fed back from the second amplifier SA11 and may output the amplified difference to the second amplifier SA11, and the second amplifier SA11 may amplify the output of the first amplifier FA11 and may output the buffered gamma voltage AGV to the third resistor string RR-ST, GR-ST or BR-ST.

Figure 3:
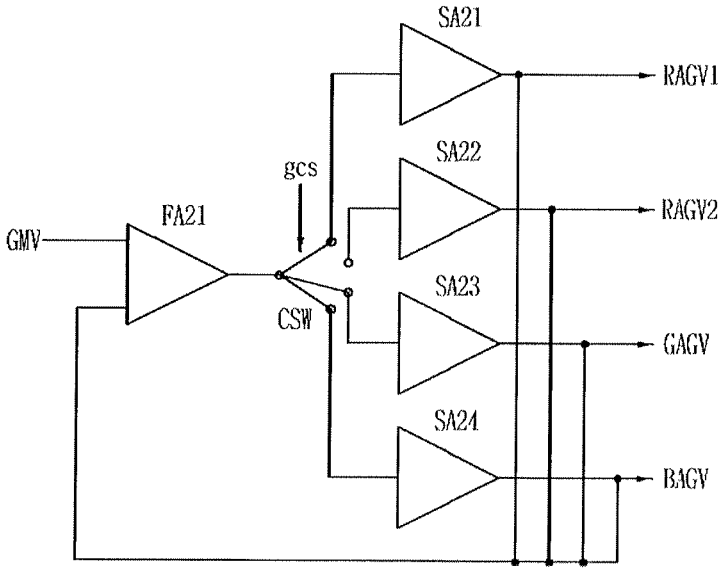
FIG. 3 is a circuit diagram illustrating an example of a gamma adjustment buffer of FIG. 1.

FIG. 3 is a circuit diagram illustrating an example of a gamma adjustment buffer of FIG. 1.

Each of the gamma adjustment buffers RCB1 to RCB4 may include a first amplifier FA21, second amplifiers SA21 to SA24, and a switch CSW.

Among the buffers of the gamma buffer units 142, 242 and 342, the gamma adjustment buffers RCB1 to RCB4 may adjust inflection points of gamma curves by changing connected nodes in the third resistor strings RR-ST, GR-ST and BR-ST. The number and positions of the gamma adjustment buffers RCB1 to RCB4 in the gamma buffer unit 142 may be changed without restriction. However, as mentioned above, the sum of the number of the fixed buffers RB1 to RB5 and the number of the gamma adjustment buffers RCB1 to RCB4 should be equal to the number of the gamma selectors RGS1 to RGS9. In the gamma adjustment buffers RCB1 to RCB4, the switch CSW may perform a switching operation to connect the first amplifier FA21 with three of the second amplifiers SA21 to SA24 in response to the gamma adjustment signal gcsr. The switch CSW may select three of the second amplifiers SA21-SA24 such that it is possible to simultaneously select specific nodes in the third resistor strings RR-ST, GR-ST and BR-ST of the respective first to third grey-scale voltage generators 100, 200 and 300. The first amplifier FA21 may amplify the difference between a gamma voltage GMV output from the corresponding gamma selector RGS2, RGS3, RGS7 or RGS8 of the gamma selection unit 141 and may output RAGV1, GAGV and BAGV fed back from the second amplifiers SA21, SA23 and SA24 connected with the first amplifier FA21, and may output the amplified difference to the second amplifiers SA21, SA23 and SA24 connected with the first amplifier FA21, as in the example illustrated in FIG. 3. In such an embodiment of the present general inventive concept, all the fed-back outputs RAGV1, GAGV and BAGV may have the same voltage level, and thus the same voltage may be applied to the first amplifier FA21 even though a plurality of outputs are fed back. The second amplifiers SA21, SA23 and SA24 connected with the first amplifier FA21 may amplify the output of the first amplifier FA21 and output the three buffered gamma voltages RAGV1, GAGV and BAGV to the three resistor strings RR-ST, GR-ST and BR-ST, respectively. In more detail, the gamma voltage RAGV1 may be applied to a selected node in the third resistor string RR-ST of the first grey-scale voltage generator 100, the gamma voltage GAGV may be applied to a selected node in the third resistor string GR-ST of the second grey-scale voltage generator 200, and the gamma voltage BAGV may be applied to a selected node in the third resistor string BR-ST of the third grey-scale voltage generator 300. In particular, since the output terminals of the second amplifiers SA21 and SA22 may be connected with different nodes in the same third resistor string RR-ST, the second amplifiers SA21 and SA22 connected with different nodes of the third resistor string RR-ST may be selected by the switching operation of the switch CSW such that an inflection point of a gamma voltage can be adjusted. In FIG. 3, only the four second amplifiers SA21 to SA24 are shown, but the gamma adjustment buffers RCB1 to RCB4 may have a larger number (e.g., twelve) of second amplifiers. For example, when each of the gamma adjustment buffers RCB1 to RCB4 has twelve second amplifiers, it is possible to select a larger number of nodes in each of the third resistor strings RR-ST, GR-ST and BR-ST of the first to third grey-scale voltage generators 100, 200 and 300. In other words, inflection points of respective R, G and B gamma voltages may be adjusted.

Figure 4:
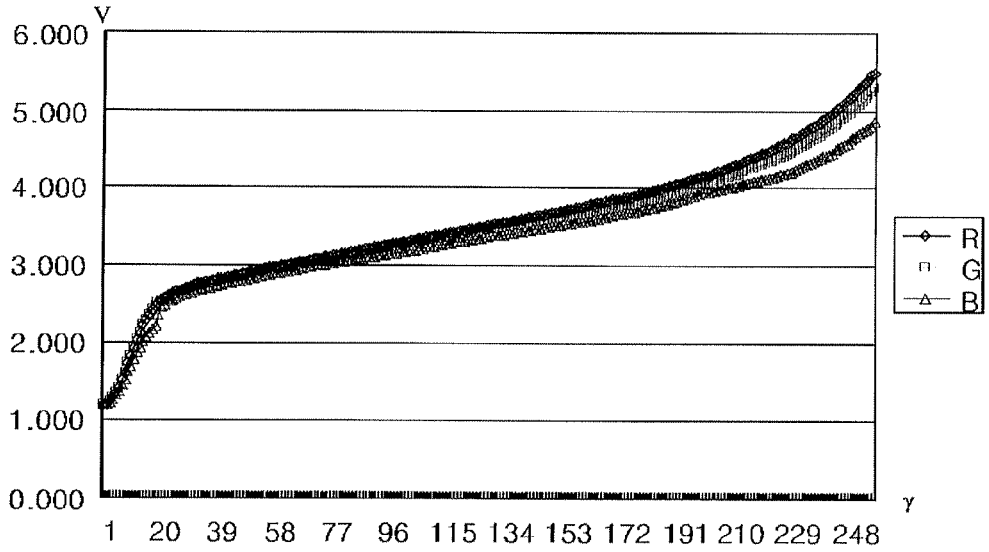
FIG. 4 is a graph illustrating grey-scale voltages generated by the separate grey-scale voltage generators of FIG. 1.

FIG. 4 is a graph illustrating grey-scale voltages generated by the separate grey-scale voltage generators of FIG. 1. In FIG. 4, the X-axis indicates a gamma (⌈) value, and the Y-axis indicates a grey-scale voltage with respect to the gamma value. As shown in FIG. 4, the display driver circuit according to an example embodiment of the present general inventive concept can generate grey-scale voltages corresponding to respective R, G and B gamma characteristic curves even if the first to third grey-scale voltage generators 100, 200 and 300 used respectively with R, G and B colors share the first and second resistor strings R-ST1 and R-ST2, the gamma adjustment buffers RCB1 to RCB4, and the gamma selectors RGS2, RGS3, RGS7 and RGS8 corresponding to the gamma adjustment buffers RCB1 to RCB4 of the first grey-scale voltage generator 100. Thus, although the separate grey-scale voltage generators 100, 200 and 300 are used, it is possible to reduce power consumption and the size of the display driver circuit.

Figure 5:
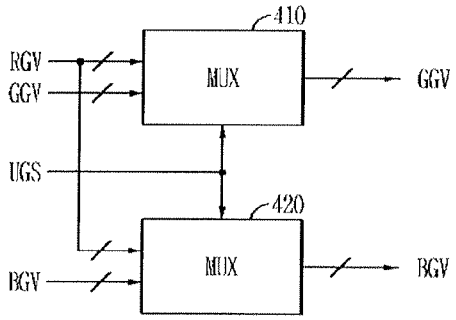
FIG. 5 is a block diagram illustrating a switch to cause a display driver circuit according to an example embodiment of the present general inventive concept to drive respective red (R), green (G) and blue (B) pixels using the same grey-scale voltage.

FIG. 5 is a block diagram illustrating a switch to cause a display driver circuit according to an example embodiment of the present general inventive concept to drive respective R, G and B pixels using the same grey-scale voltage.

As previously described, when a display driver circuit is implemented by separate grey-scale voltage generators, outputs of the separate grey-scale voltage generators are respectively applied to R, G and B pixels even if the R, G and B pixels are driven by the same grey-scale voltage. As a result, all the separate grey-scale voltage generators must be driven, and power consumption is not reduced.

To solve this problem, the display driver circuit according to an example embodiment of the present general inventive concept may have two MUXs 410 and 420 selecting a gamma voltage when respective R, G and B pixels are driven by the same (i.e., single) grey-scale voltage. The grey-scale voltage selection MUX 410 may receive two groups RGV and GGV of grey-scale voltages RV0 to RV63 and GV0 to GV63 output from the first and second grey-scale voltage generators 100 and 200, and may select and output grey-scale voltages RV0 to RV63 or GV0 to GV63 of one of the two groups RGV and GGV in response to a single grey-scale voltage selection signal UGS. Likewise, the grey-scale voltage selection MUX 420 may receive two groups RGV and BGV of grey-scale voltages RV0 to RV63 and BV0 to BV63 output from the first and third grey-scale voltage generators 100 and 300, and may select and output grey-scale voltages RV0 to RV63 or BV0 to BV63 of one of the two groups RV and BV in response to the single grey-scale voltage selection signal UGS.

More specifically, when different grey-scale voltages are applied to respective R, G and B pixels, the first and second MUXs 410 and 420 may select the grey-scale voltage groups GGV (GV0 to GV63) and BGV (BV0 to BV63) output from the second and third grey-scale voltage generators 200 and 300, but when a single grey-scale voltage is applied to respective R, G and B pixels, both of the first and second MUXs 410 and 420 may select the gamma voltage group RGV (RV0 to RV63) output from the first grey-scale voltage generator 100 in response to the single grey-scale voltage selection signal UGS. Thus, when a single grey-scale voltage is applied to R, G and B pixels, the second and third grey-scale voltage generators 200 and 300 need not operate. Although not illustrated in the drawing, a circuit that activates or deactivates the second and third grey-scale voltage generators 200 and 300 in response to the single grey-scale voltage selection signal UGS may be additionally included to reduce power consumption.

Consequently, when the second and third grey-scale voltage generators 200 and 300 are deactivated while a single grey-scale voltage is used, only the first grey-scale voltage generator 100 generates grey-scale voltages RV0 to RV63, and power consumption can be reduced by a third.

Figure 6:
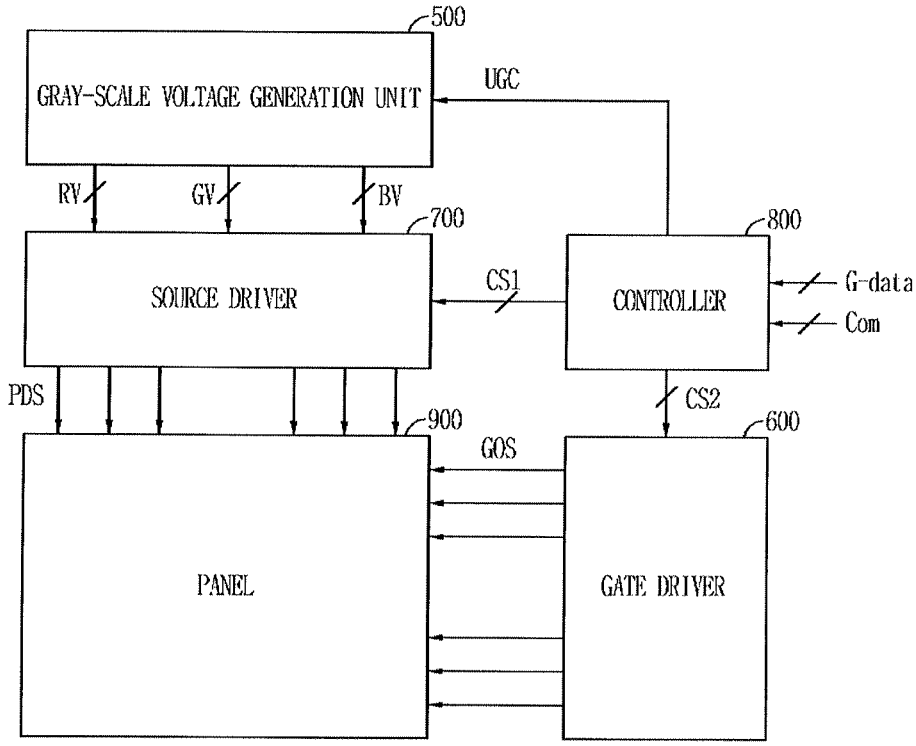
FIG. 6 is a block diagram illustrating a display driver circuit according to an example embodiment of the present general inventive concept.

FIG. 6 is a block diagram illustrating a display driver circuit according to an example embodiment of the present general inventive concept.

Referring to FIG. 6, the display driver circuit may include a grey-scale voltage generation unit 500, a gate driver 600, a source driver 700 and a controller 800, and may drive a display panel 900.

The display driver circuit may provide three groups of grey-scale voltages RV0 to RV63, GV0 to GV63, and BV0 to BV63 to the source driver 700 using the grey-scale voltage generation unit 500 having a plurality of grey-scale voltage generators, such as the three grey-scale voltage generators 100, 200 and 300 of FIG. 1, may apply a display data voltage PDS to data lines of the display panel 900 using the source driver 700, and may apply a gate-on voltage GOS to gate lines of the display panel 900 using the gate driver 600, thereby driving the display panel 900. Here, the source driver 700 and the gate driver 600 may operate according to respective R, G and B pixels. The controller 800 may respectively provide a source driver control signal CS1 and gate driver control signal CS2 to the source driver 700 and the gate driver 600 in response to image data G-data and a command Com applied from outside, thereby controlling the gate driver 600 and the source driver 700. The controller 800 may apply a single grey-scale voltage selection signal UGS to the grey-scale voltage generation unit 500.

Figure 7:
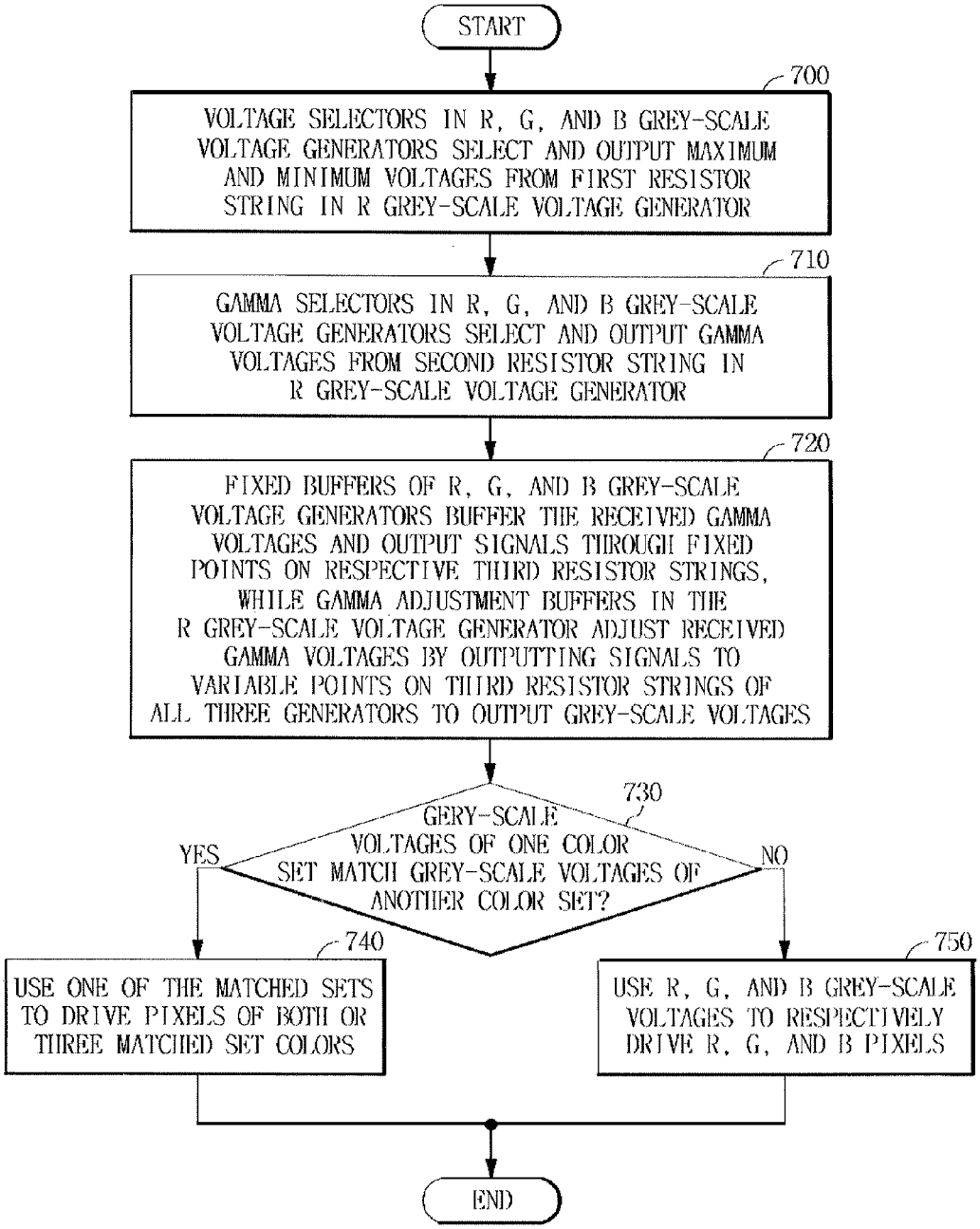
FIG. 7 is a flow chart illustrating a method of driving R, G and B pixels with separate grey-scale voltage generators according to an example embodiment of the present general inventive concept.

FIG. 7 is a flow chart illustrating a method of driving R, G and B pixels with separate grey-scale voltage generators according to an example embodiment of the present general inventive concept.

In operation 700, respective maximum and minimum reference voltage selectors of R, G, and B grey-scale voltage generators select and output respective maximum and minimum voltages from a common first resistor string provided in the R grey-scale voltage generator.

In operation 710, gamma selectors provided in respective gamma voltage adjustment units of the R, G, and B grey-scale voltage generators select and output gamma voltages from a common second resistor string provided in the R grey-scale voltage generator.

In operation 720, fixed buffers provided in each of the R, G, and B grey-scale voltage generators buffer the gamma voltages received from respective gamma selectors and output the signals through fixed points on third resistor strings provided in each of the R, G, and B grey-scale voltage generators to output grey-scale voltages, while gamma adjustment buffers in the R grey-scale voltage generator receive, buffer, and adjust the gamma voltages received from gamma selectors by outputting signals to variable points on the third resistor strings of each of the grey-scale voltage generators to output grey-scale voltages.

In operation 730, it is determined whether the output grey-scale voltages of any one color R, G, or B match one or two of the other colors.

If there is a match between two or more color sets of grey-scale voltages, for example, if the R grey-scale values match the G and/or B grey-scale values, then only one of the matched sets of grey-scale voltages may be used to drive the pixels corresponding to all of the matched sets in operation 740.

If there is no match between any of the color sets of grey-scale voltages, the output grey-scale voltages of each of the R, G, and B grey-scale voltage generators respectively drive the R, G, and B pixels in operation 750.

Consequently, in a display driver circuit having separate grey-scale voltage generators according to an example embodiment of the present general inventive concept, three grey-scale voltage generators used respectively with R, G and B colors share first and second resistor strings, gamma voltage selectors, and gamma adjustment buffers, and thus it is possible to reduce the size and power consumption of the display driver circuit. Also, since a grey-scale voltage selection MUX may be provided, it is possible to further reduce the power consumption by deactivating two grey-scale voltages when only a single grey-scale voltage is output.

The foregoing is illustrative of example embodiments of the present general inventive concept and is not to be construed as limiting thereof. Although a few example embodiments have been described, those skilled in the art will readily appreciate that many modifications are possible in example embodiments without materially departing from the novel teachings and advantages. Accordingly, all such modifications are intended to be included within the scope of this inventive concept as defined in the claims. In the claims, means-plus-function clauses are intended to cover the structures described herein as performing the recited function, and not only structural equivalents but also equivalent structures. Therefore, it is to be understood that the foregoing is illustrative of various example embodiments and is not to be construed as limited to the specific embodiments disclosed, and that modifications to the disclosed embodiments, as well as other embodiments, are intended to be included within the scope of the appended claims.

Although a few embodiments of the present general inventive concept have been illustrated and described, it would be appreciated by those skilled in the art that changes may be made in these embodiments without departing from the principles and spirit of the present general inventive concept, the scope of which is defined in the claims and their equivalents.

What is claimed is:

1. A display driver circuit, comprising:

a grey-scale voltage generation unit having first to third grey-scale voltage generators, each of the first to third grey-scale voltage generators generating n (wherein n is a natural number larger than 2) grey-scale voltages by selecting a maximum reference voltage and a minimum reference voltage among first distribution voltages, selecting a predetermined number of voltages among second distribution voltages, and distributing selected voltages, wherein the first grey-scale voltage generator includes:

a first resistor string configured to generate the first distribution voltages by receiving first and second power supply voltages, and a second resistor string configured to generate the second distribution voltages by receiving a first maximum reference voltage and a first minimum reference voltage selected among the first distribution voltages, wherein the second grey-scale voltage generator selects a second maximum reference voltage and a second minimum reference voltage among the first distribution voltages from the first resistor string and selects a predetermined number of voltages among the second distribution voltages from the second resistor string receiving the second maximum reference voltage and the second minimum reference voltage, and wherein the third grey-scale voltage generator selects a third maximum reference voltage and a third minimum reference voltage among the first distribution voltages from the first resistor string and selects a predetermined number of voltages among the second distribution voltages from the second resistor string receiving the third maximum reference voltage and the third minimum reference voltage.

2. The display driver circuit according to claim 1, wherein each of the first to third grey-scale voltage generators comprises:

a reference voltage selection register configured to output a maximum reference voltage selection signal and a minimum reference voltage selection signal;

a gamma selection register configured to output a plurality of gamma selection signals; and a reference voltage selection unit having a maximum reference voltage selector to select the maximum reference voltage and output the maximum reference voltage as a first grey-scale voltage in response to the maximum reference voltage selection signal, and a minimum reference voltage selector to select the minimum reference voltage and output the minimum reference voltage as an nth grey-scale voltage in response to the minimum reference voltage selection signal.

3. The display driver circuit according to claim 2, wherein the first grey-scale voltage generator further includes a gamma adjustment register configured to output a plurality of gamma adjustment signals.

4. The display driver circuit according to claim 3, wherein the first grey-scale voltage generator further comprises:

a first gamma selection unit having m (wherein m is a natural number smaller than n) first gamma selectors each to select and output one of voltages distributed by the second resistor string as a first gamma voltage in response to a corresponding one of the gamma selection signals;

a third resistor string configured to generate second to $(n-1)^{th}$ grey-scale voltages by distributing gamma voltages applied from first and $m^{th}$ first gamma selectors among the m first gamma selectors; and a first gamma buffer unit having p (wherein p is a natural number equal to or smaller than m) first fixed buffers to receive, buffer and output corresponding first gamma voltages among the m first gamma voltages to designated nodes among a plurality of nodes in the third resistor string, and (m−p) gamma adjustment buffers to select specific nodes among the nodes in the third resistor string in response to corresponding gamma adjustment signals among the gamma adjustment signals, and to receive, buffer and output corresponding first gamma voltages among the m first gamma voltages to the selected nodes.

5. The display driver circuit according to claim 4, wherein each of the second and third grey-scale voltage generators further comprises:

a second gamma selection unit having p second gamma selectors each to select and output one of the voltages distributed by the second resistor string as a second gamma voltage in response to a corresponding one of the gamma selection signals;

a fourth resistor string configured to generate second to (n−1)th grey-scale voltages by distributing gamma voltages applied from first and $p^{th}$ second gamma selectors among the p second gamma selectors; and a second gamma buffer unit having p second fixed buffers to receive, buffer and output corresponding second gamma voltages among the p second gamma voltages to designated nodes among the nodes in the third resistor string.

6. The display driver circuit according to claim 5, wherein each of the (m−p) gamma adjustment buffers selects a specific node among a plurality of nodes in the fourth resistor string in response to the corresponding one of the gamma adjustment signals, and receives, buffers and outputs the corresponding first gamma voltage among the m first gamma voltages to the selected node.

7. The display driver circuit according to claim 6, wherein each of the (m−p) gamma adjustment buffers includes:

a first amplifier configured to receive the corresponding first gamma voltage and a feedback voltage, and sense, amplify and output a voltage difference;

a plurality of second amplifiers configured to receive, amplify and output the output of the first amplifier to a corresponding node in the third or fourth resistor string, and apply the voltage output to the corresponding node to the first amplifier as the feedback voltage; and a switch configured to select at least one of the second amplifiers in response to the corresponding gamma adjustment signal, and transfer the output of the first amplifier to the selected second amplifier.

8. The display driver circuit according to claim 7, wherein the grey-scale voltage generation unit further includes:

a first grey-scale voltage selection multiplexer (MUX) configured to select and output one of a first grey-scale voltage group of the n grey-scale voltages output from the first grey-scale voltage generator and a second grey-scale voltage group of the n grey-scale voltages output from the second grey-scale voltage generator in response to a single grey-scale voltage selection signal; and a second grey-scale voltage selection MUX configured to select and output one of the first grey-scale voltage group and a third grey-scale voltage group of the n grey-scale voltages output from the third grey-scale voltage generator in response to the single grey-scale voltage selection signal.

9. The display driver circuit according to claim 8, wherein the second and third grey-scale voltage generators are deactivated in response to the single grey-scale voltage selection signal.

10. The display driver circuit according to claim 9, further comprising:

a controller configured to output a source driver control signal, a gate driver control signal, and the single grey-scale voltage selection signal in response to image data and a command applied from outside;

a source driver configured to receive the first to third grey-scale voltage groups and apply a display data voltage to data lines of a display panel in response to the source driver control signal; and a gate driver configured to apply a gate-on voltage to gate lines of the display panel in response to the gate driver control signal.

11. The display driver circuit according to claim 1, wherein the distributing selected voltages comprises adjusting some of the selected voltages by adjustment buffers and distributing the adjusted voltages.

12. The display driver circuit according to claim 1, wherein at least two of the first to third maximum reference voltages are the same or the first to third maximum reference voltages are different from each other, and wherein at least two of the first to third minimum reference voltages are the same or the first to third minimum reference voltages are different from each other.

* * * * *